US005924889A

United States Patent [19]

Wang

[11] Patent Number: 5,924,889

[45] Date of Patent: Jul. 20, 1999

[54] COAXIAL CABLE CONNECTOR WITH INDICATOR LIGHTS

[76] Inventor: Tsan-Chi Wang, 4th Floor, No. 8, Alley 8, Lane SSu Wei, Chung Chen Rd., Hsin-Tien City, Taipei Hsien, Taiwan

[21] Appl. No.: 08/831,247

[22] Filed: Apr. 2, 1997

[30] Foreign Application Priority Data

Dec. 31, 1996 [TW] Taiwan ..... 85220475

[51] Int. Cl.[6] ..... H01R 3/00

[52] U.S. Cl. ..... 439/490

[58] Field of Search ..... 439/490, 63, 581

[56] References Cited

U.S. PATENT DOCUMENTS 4,386,818 6/1983 Millhimes ..... 439/490
5,601,451 2/1997 Driones et al. ..... 439/490
5,700,157 12/1997 Chung ..... 439/490
5,704,802 1/1998 Loudermilk ..... 439/490
5,764,043 6/1998 Czosnowski et al. ..... 439/490

*Primary Examiner*—Steven L. Stephan
*Assistant Examiner*—Brian J. Biggi
*Attorney, Agent, or Firm*—Dougherty & Troxell

[57] ABSTRACT

A coaxial cable connector including a base and at least one jack, each jack including a tubular shell, a signal terminal mounted within the tubular shell, and an insulative sleeve mounted inside the tubular shell to separate the signal terminal from the tubular shell, the base having at least one coupling chamber adapted for receiving the at least one jack respectively, at least one lamp hole, and at least one indicator light respectively mounted in the at least one lamp hole for indicating the status of the coaxial cable.

6 Claims, 10 Drawing Sheets

COAXIAL CABLE CONNECTOR WITH INDICATOR LIGHTS

BACKGROUND OF THE INVENTION

1. Field of the Invention

The present invention relates to coaxial cable connectors, and more particularly to such a coaxial cable connector which has indicator lights adapted for indicating the connection of a network card or the transmission of a signal.

2. Description of the Prior Art

Conventional coaxial cable connectors are commonly designed for signal transmission through coaxial cables in for example a network system. When there is a transmission malfunction or disconnection of the matched network card, the user cannot immediately find the problem. Therefore, there is a strong demand for means that can indicate the connection of a matched network card or the transmission of a signal. Mounting indicator lights in network cards can be a measure capable of solving the aforesaid problem. However, the procedure of installing an indicator light in a network card is complicated.

SUMMARY OF THE INVENTION

The present invention has been accomplished under the circumstances in view. It is the main object of the present invention to provide a coaxial cable connector which has indicator means to indicate the connection of a network card or the transmission of a signal, so that any malfunction or abnormality can be quickly found out and eliminated.

According to the present invention, the coaxial cable connector comprises a base and at least one jack. Each jack comprises a tubular shell, an insulative shell, and a signal terminal. The tubular shell is a hollow metal shell connected with a ground terminal. The signal terminal is coaxially mounted within the tubular shell. The insulative sleeve is coaxially mounted within the tubular shell around the signal terminal, to separate the signal terminal from the tubular shell. The base comprises at least one coupling chamber adapted for receiving the at least one jack respectively, at least one lamp hole, and at least one indicator light respectively mounted in the at least one lamp hole for indicating the status of the coaxial cable.

FIGS. from 7 to 21 show different embodiments of the coaxial cable connector according to the present invention.

DETAILED DESCRIPTION OF THE PREFERRED EMBODIMENTS

Figure 1:
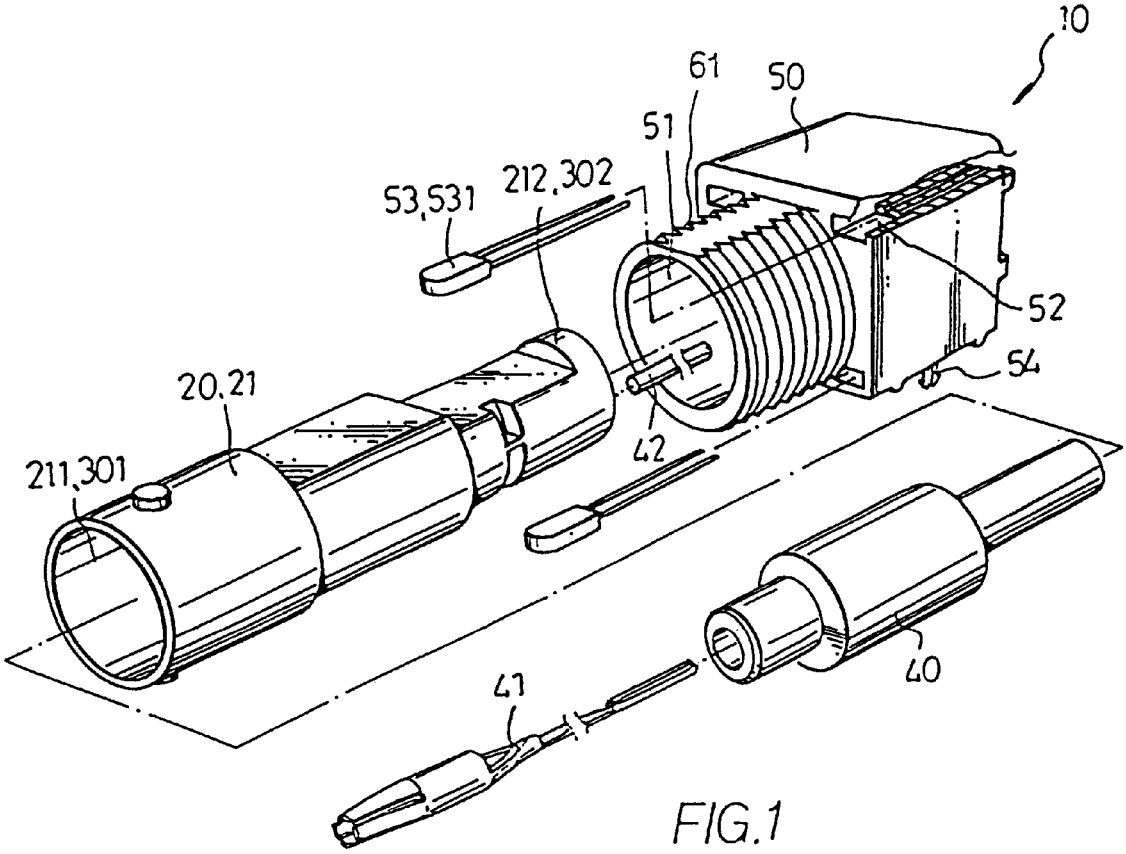
FIG. 1 is an exploded view of a coaxial cable connector according to a first embodiment of the present invention.
Figure 2:
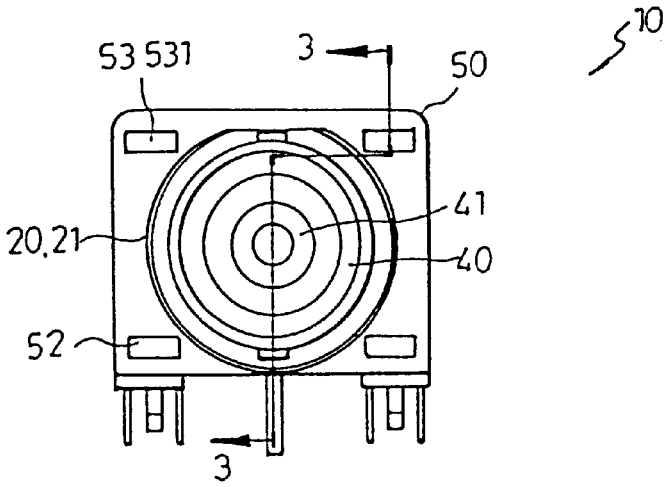
FIG. 2 is a front view of the first embodiment of the present invention.
Figure 3:
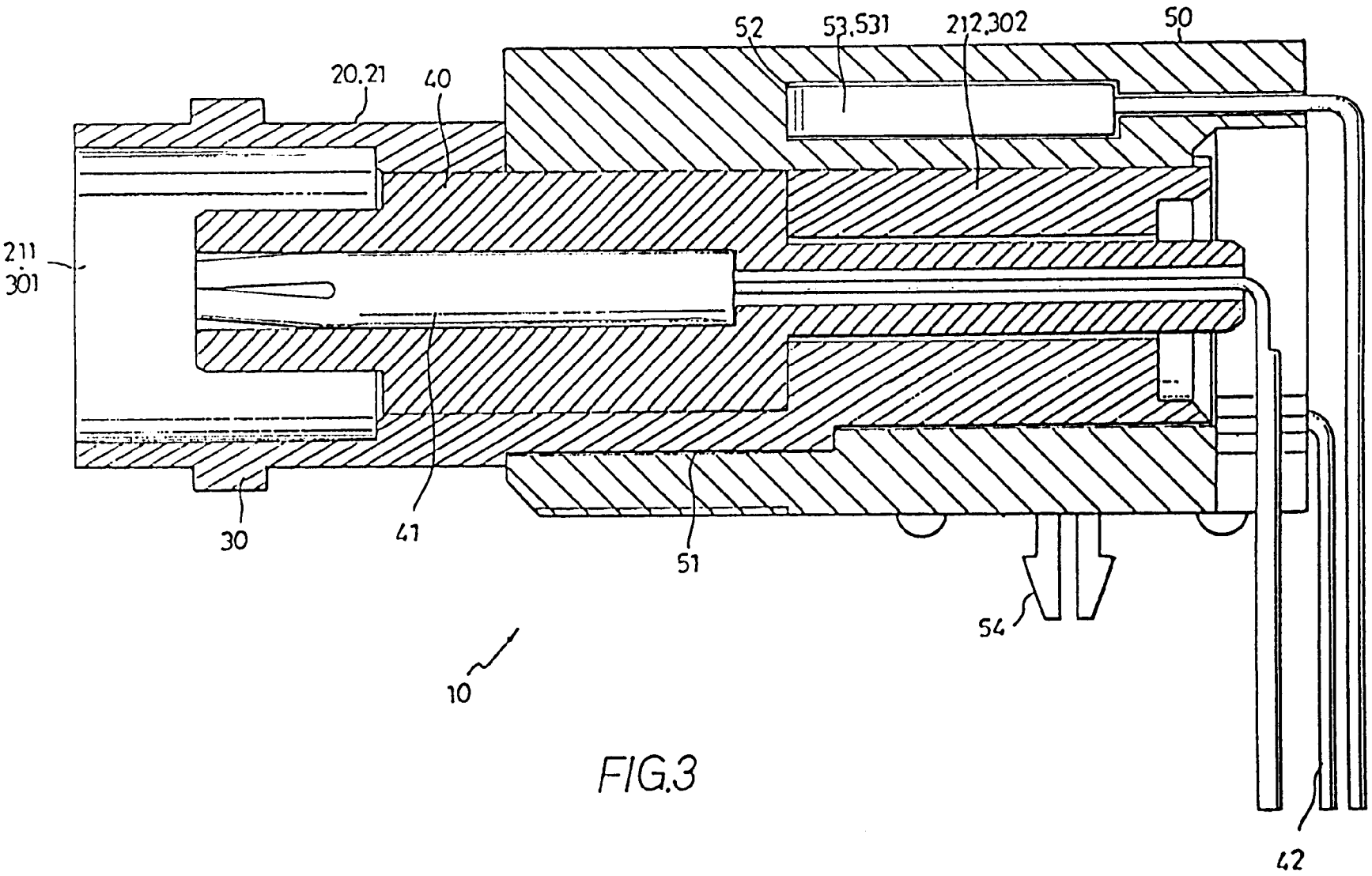
FIG. 3 is a sectional view in an enlarged scale taken along line 3—3 of FIG. 2.

Referring to FIGS. 1, 2 and 3, a coaxial cable connector 10 comprises a connector 20, and a base 50.

The connector 20 is for example a BNC jack 21. The direction of "front end" described hereinafter means the direction of the coupling end to the BNC plug, and the direction of "rear end" means the direction of the coupling end to the PC board. Therefore, the end 212 of the BNC jack 21 which is adapted for coupling to the base 50 is defined as the rear end, and the opposite end 211 of the BNC jack 21 is defined as the front end.

The BNC jack 21 comprises a tubular shell 30, an insulative sleeve 40, and a signal terminal 41. The tubular shell 30 is made from metal, having a front end 301 and a rear end 302. The front end 301 and rear end 302 of the tubular shell 30 coincide with the front end 211 and 212 of the BNC jack 21 respectively. The tubular shell 30, the insulative sleeve 40 and the signal terminal 41 are coaxially mounted within one inside another, i.e., the insulative sleeve 40 is mounted within the tubular shell 30, and the signal terminal 41 is mounted within the insulative sleeve 40. The signal terminal 41 is isolated from the tubular shell 30 by the insulative sleeve 40. Further, a ground terminal 42 is connected to the tubular shell 30.

The base 50 comprises a coupling chamber 51, outer threads 61 around the periphery of the coupling chamber 51, a plurality of lamp holes 52, and a plurality of indicator lights 53. The base 50 is made in integrity. The coupling chamber 51 receives the BNC jack 21. The lamp holes 52 receive the indicator lights 53. It is preferably made in such a manner that one lamp hole 52 receives one indicator light 53. The lamp holes 52 have a shape fitting the indicator lights 53. The indicator lights 53 can be for example light emitting diodes 531. Further, the base 50 has locating pins 54 adapted for fastening to the PC board. The locating pins 54 may be disposed in contact with the tubular shell 30, so as to serve as grounding terminals.

Figure 4:
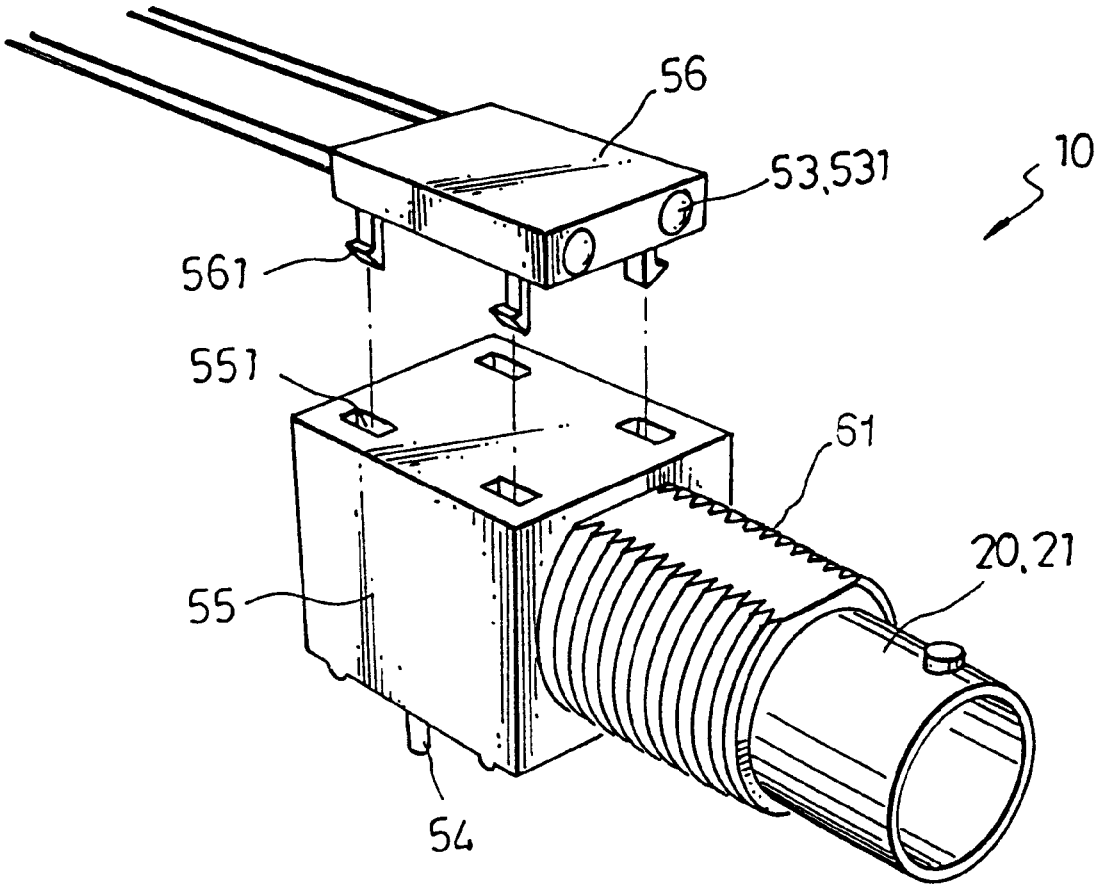
FIG. 4 is an exploded view of a coaxial cable connector according to a second embodiment of the present invention.

FIG. 4 shows a coaxial cable connector 10 according to a second embodiment of the present invention, in which the base is made in two separate parts, namely, the first base member 55 and the second base member 56. The first base member 55 holds the indicator lights 53 (LEDs 531), having a plurality of female fastening means for example retaining holes 551. The second base member 56 has a plurality of male fastening means for example hooks 561 adapted for fastening to the retaining holes 551 of the first base member 55.

Figure 5:
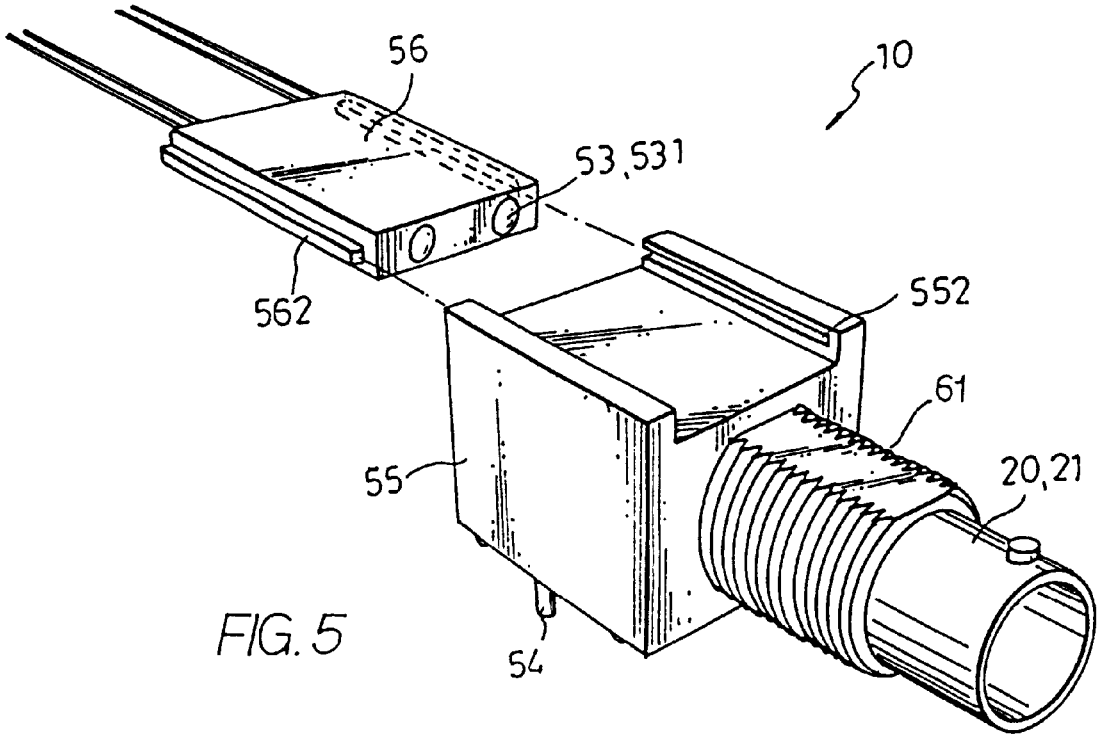
FIG. 5 is an exploded view of a coaxial cable connector according to a third embodiment of the present invention.

FIG. 5 shows a coaxial cable connector 10 according to a third embodiment of the present invention, in which the first base member 55 has coupling grooves 552, and the second base member 56 has coupling tongues 562 adapted for coupling to the coupling grooves 552 of the first base member 55.

Figure 6:
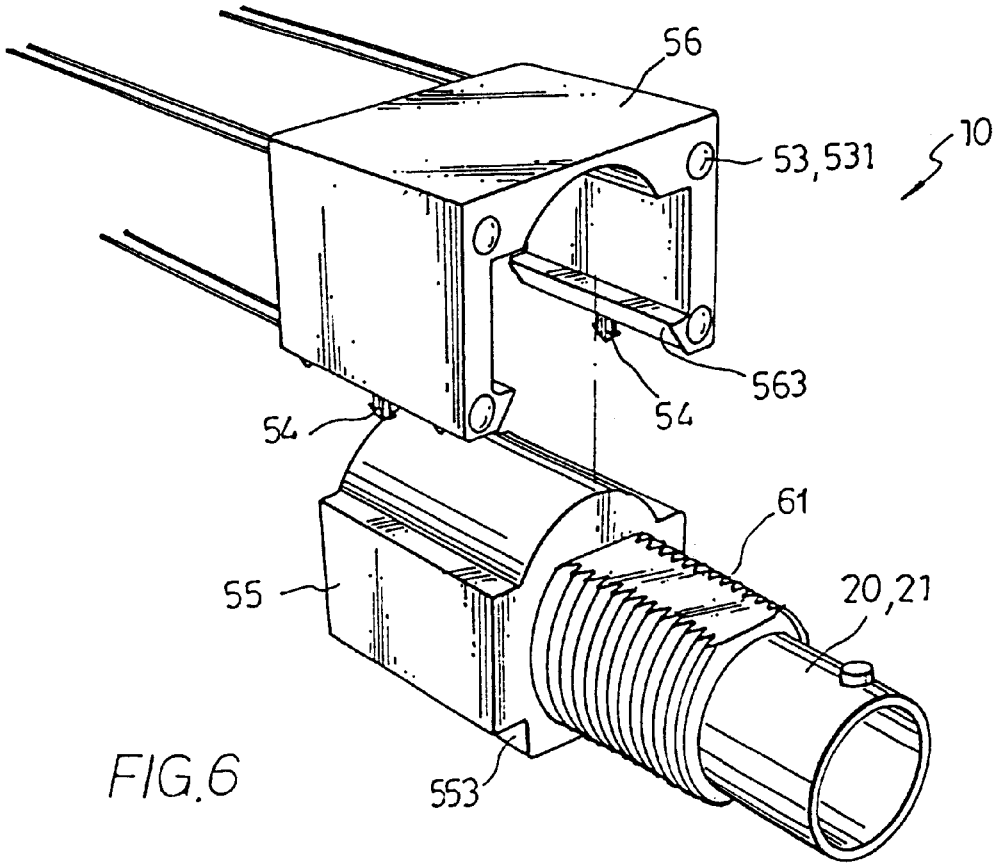
FIG. 6 is an exploded view of a coaxial cable connector according to a fourth embodiment of the present invention.

FIG. 6 shows a coaxial connector 10 according to a fourth embodiment of the present invention, in which the first base member 55 has a plurality of locating grooves 553, the second base member 56 is mounted around the first base member 55, having a plurality of hooked portions 563 forced into engagement with the locating grooves 553 of the first base member 55 respectively.

In the aforesaid second, third and fourth embodiments, the indicator lights 53 are mounted in the second base member 56, and then the second base member 56 is fastened to the first base member 55. The first base member 55 can be a metal shell made with the tubular shell 30 of the BNC jack 20 in integrity.

FIGS. from 7 to 20 show other different embodiments of the present invention.

Figure 7:
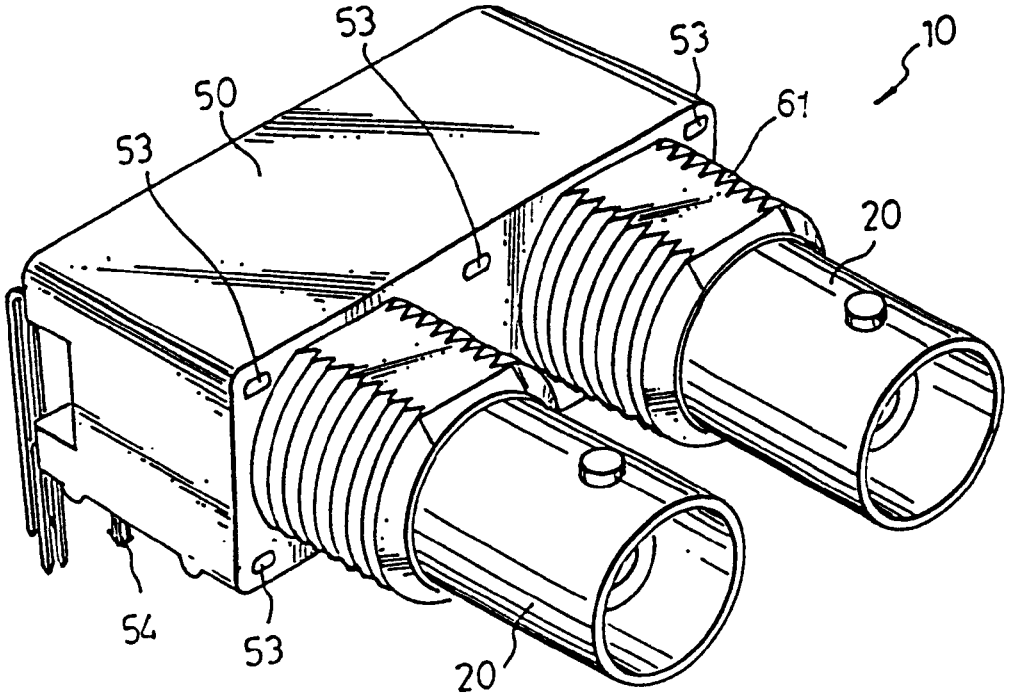
Figure 8:
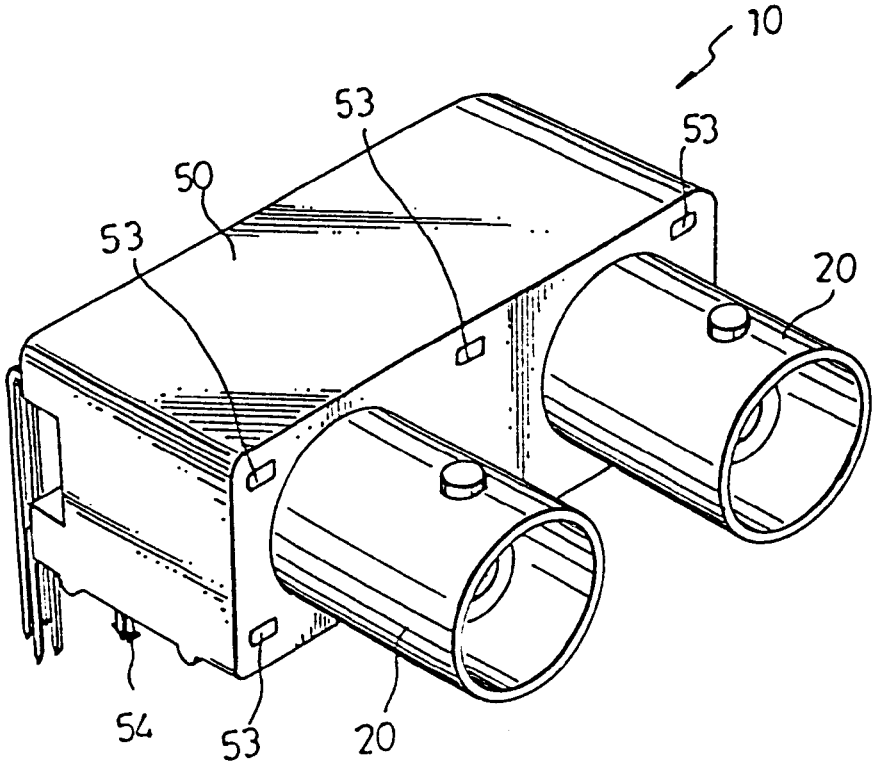

FIGS. 7 and 8 show two horizontal type dual-jack coaxial cable connectors according to the present invention.

However, the BNC jacks 20 shown in FIG. 7 have outer threads 61; the BNC jacks 20 shown in FIG. 8 commonly have a smooth outside wall.

Figure 9:
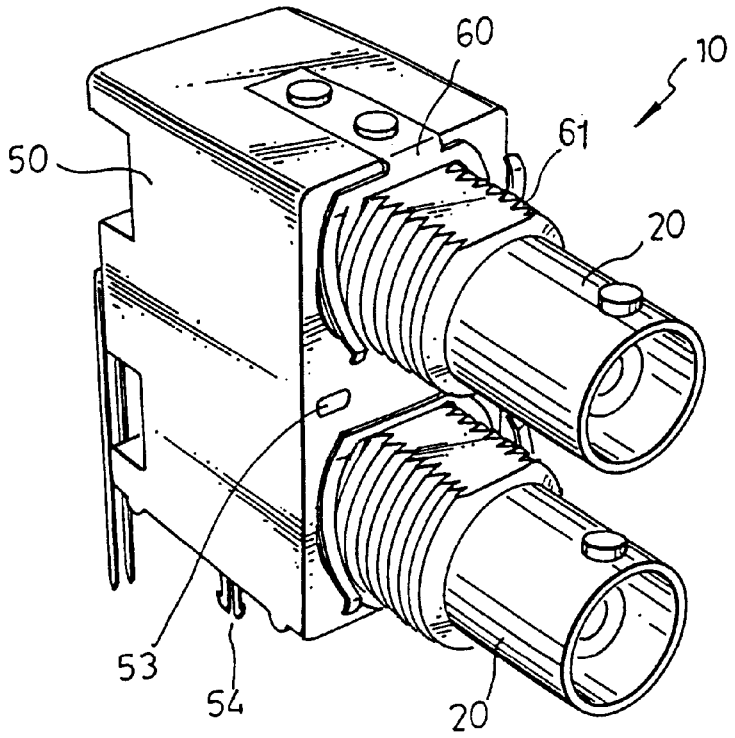
Figure 10:
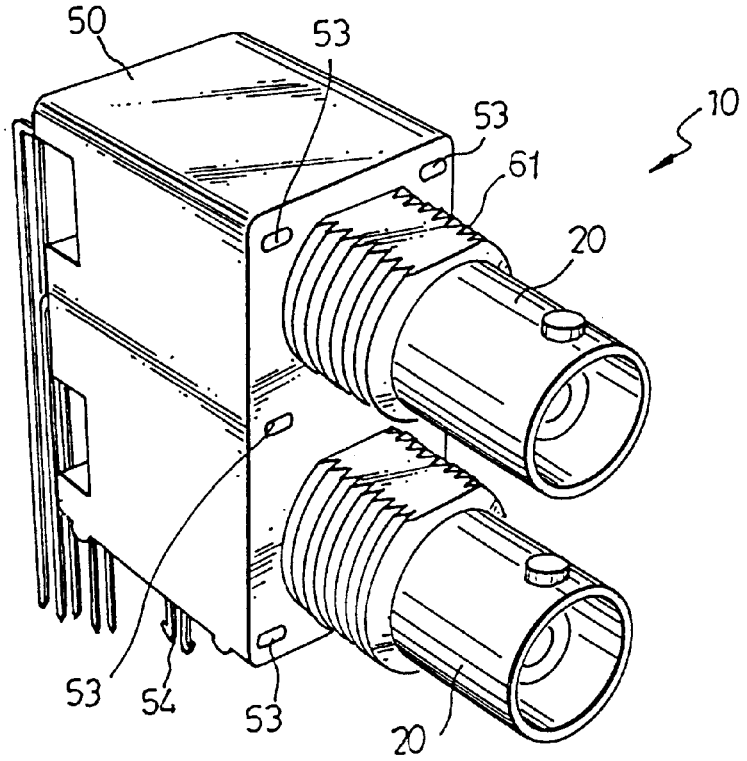
Figure 11:
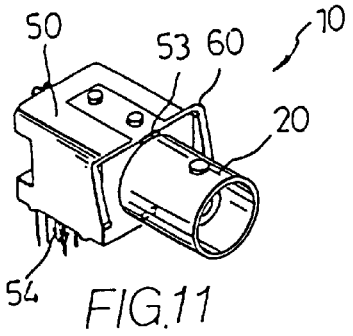
Figure 12:
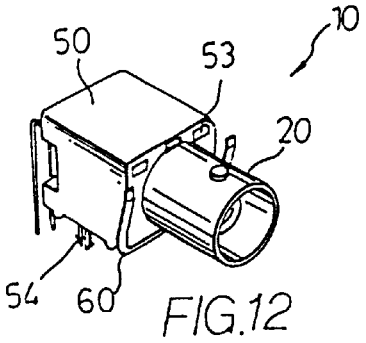
Figure 13:
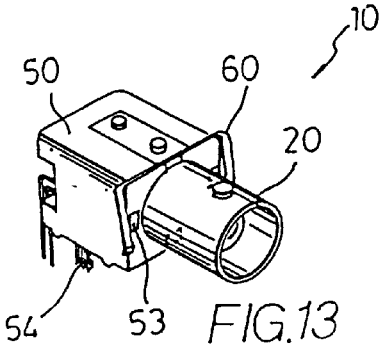
Figure 14:
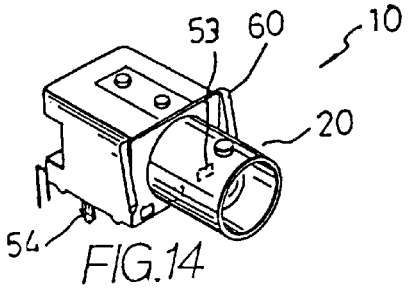

FIGS. 9 and 10 show two vertical type dual-jack coaxial cable connectors according to the present invention. The differences between these two vertical type dual-jack coaxial cable connectors are at the design of the clamp 60 (for holding down filter elements) and the locations of the indicator lights 53.

FIGS. from 11 to 14 show different single jack, threadless coaxial cable connectors according to the present invention. The differences among these coaxial cable connectors are at the location of the clamp 60, and the locations and number of the indicator lights 53.

Figure 15:
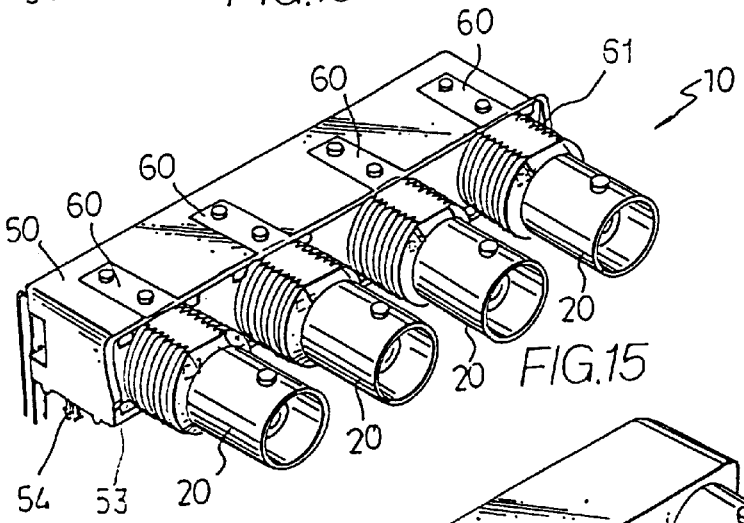

FIG. 15 shows a coaxial cable connector having four BNC jacks 20 arranged in a line according to the present invention.

Figure 16:
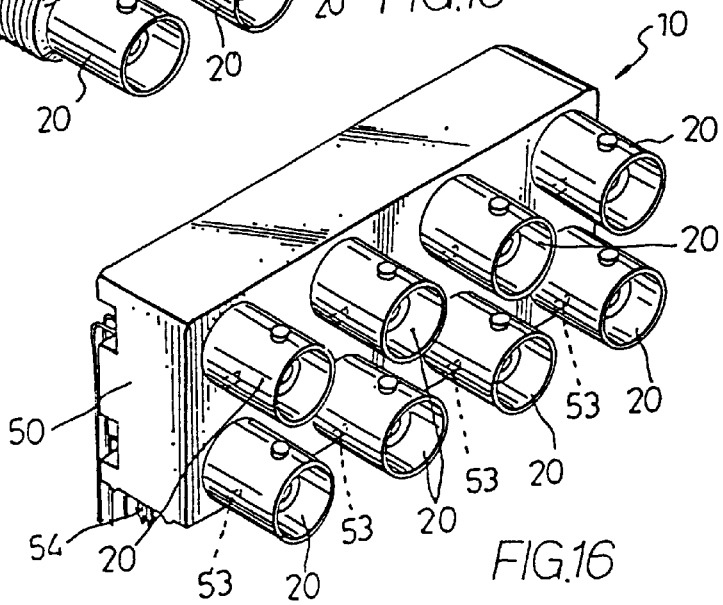

FIG. 16 shows a coaxial cable connector having four pairs of BNC jacks 20 arranged in two lines according to the present invention.

Figure 17:
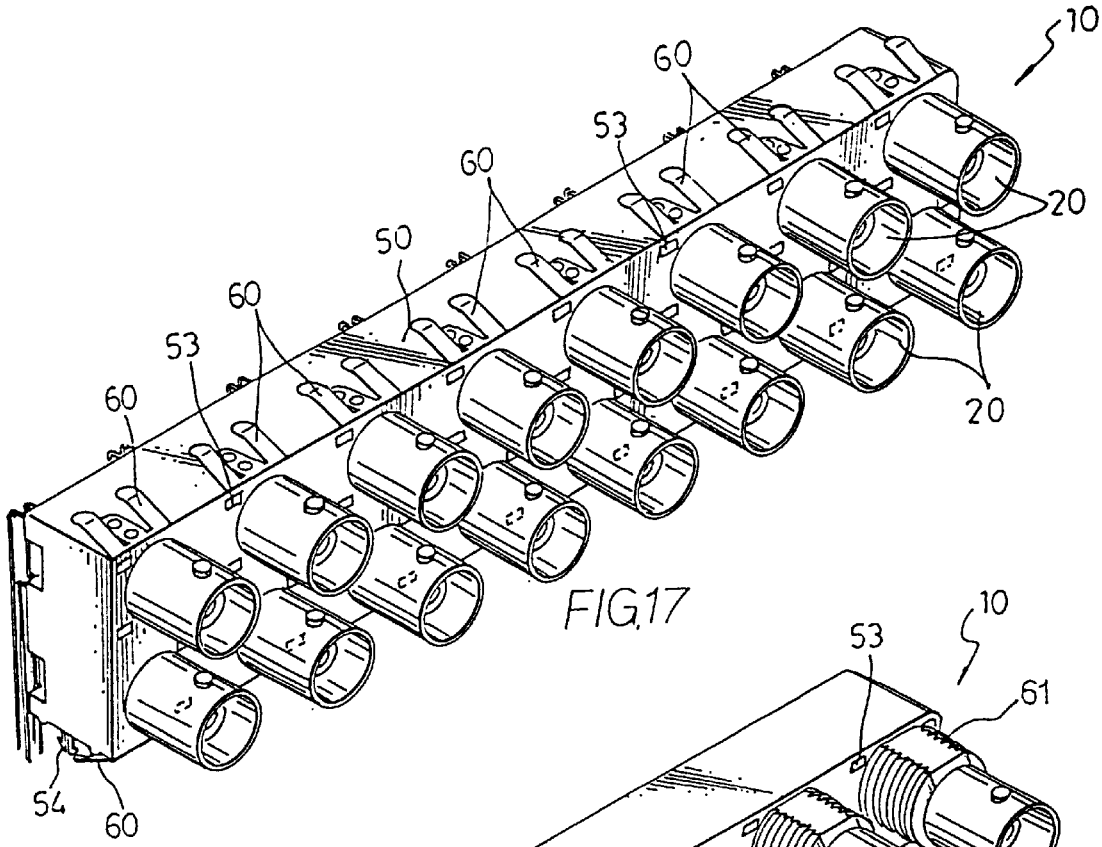
Figure 18:
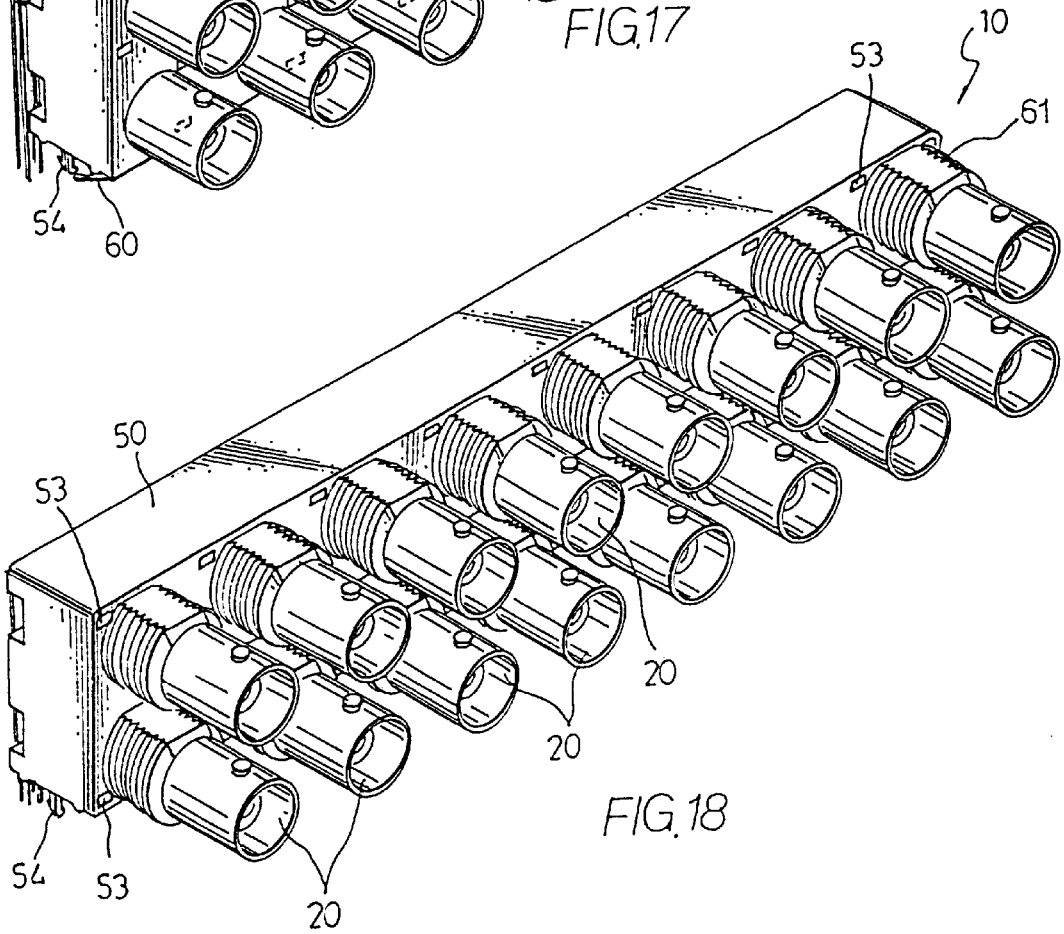

FIGS. 17 and 18 show two coaxial cable connectors, each having eight pairs of BNC jacks 20 arranged in two lines. However, the BNC jacks 20 shown in FIG. 17 commonly have a smooth outside wall and clamps 61 for holding down filter elements; the BNC jacks 20 shown in FIG. 18 commonly have outer threads 61.

Figure 19:
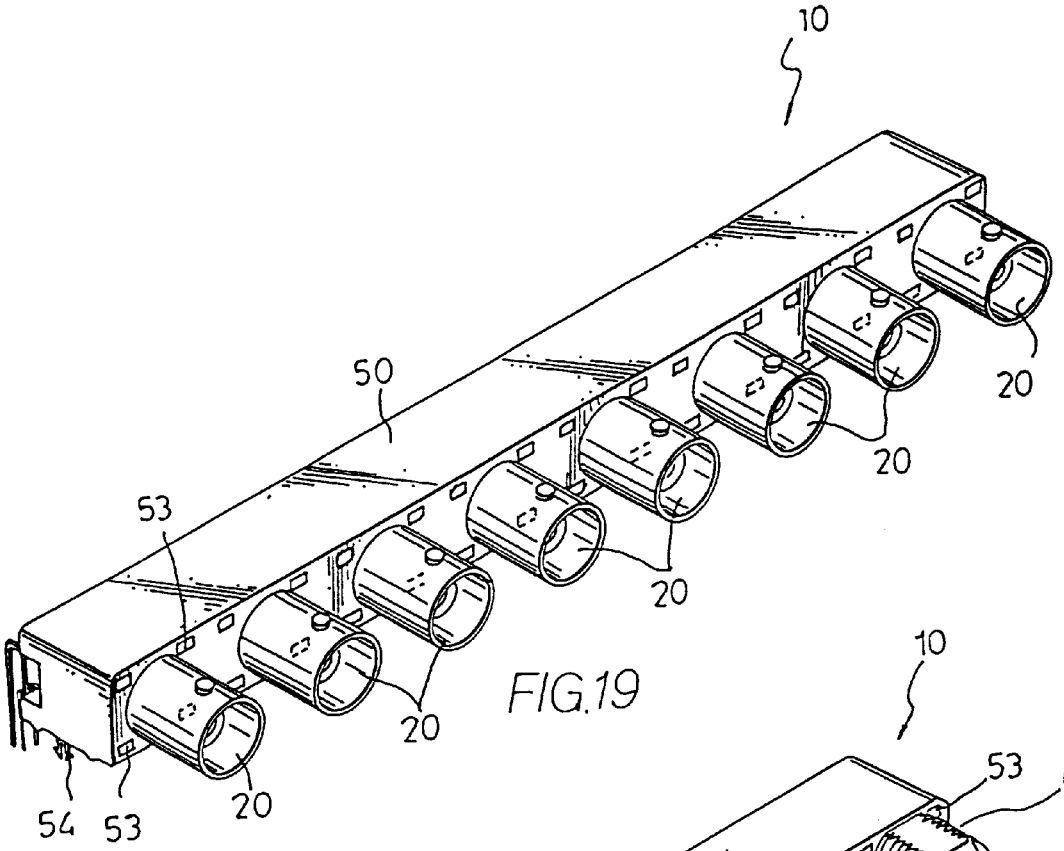
Figure 20:
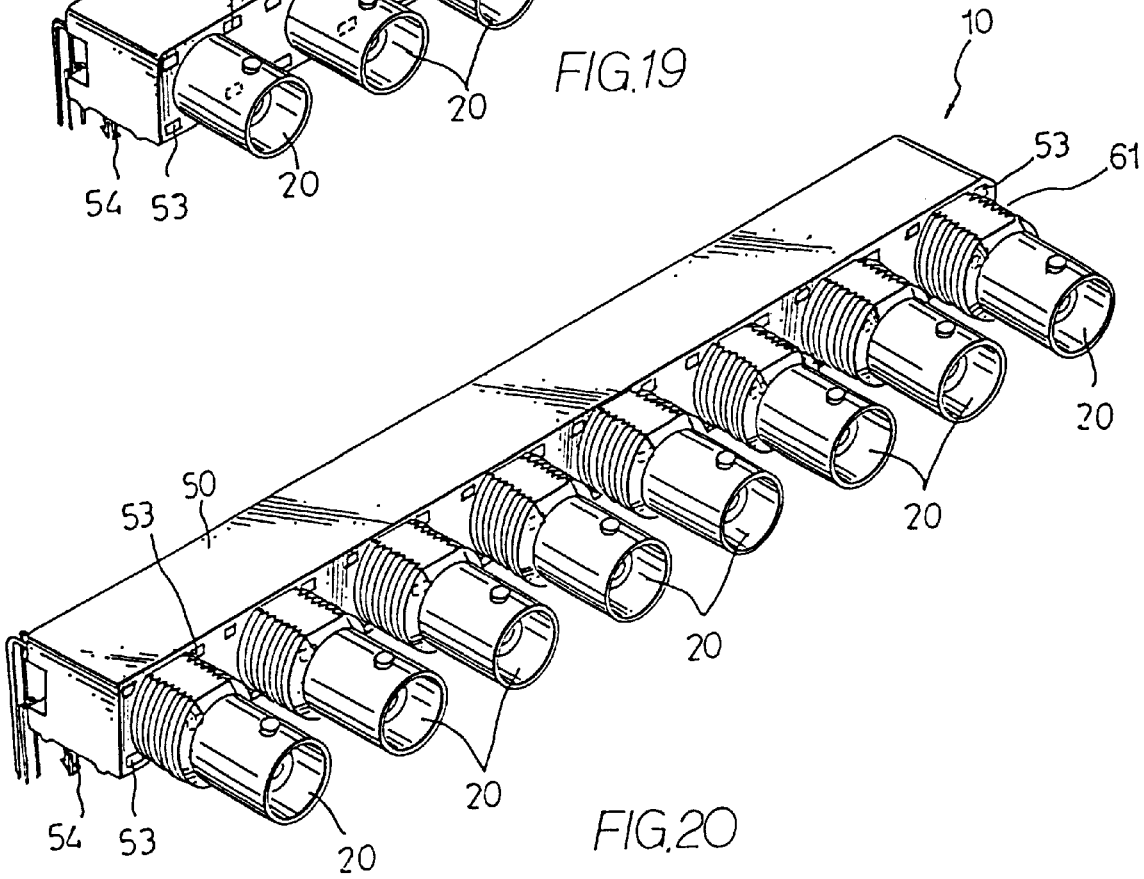

FIGS. 19 and 20 show two coaxial cable connectors, each having eight BNC jacks 20 arranged in a line. However, the BNC jacks 20 shown in FIG. 19 commonly have a smooth outside wall; the BNC jacks 20 shown in FIG. 20 commonly have outer threads 61.

Figure 21:
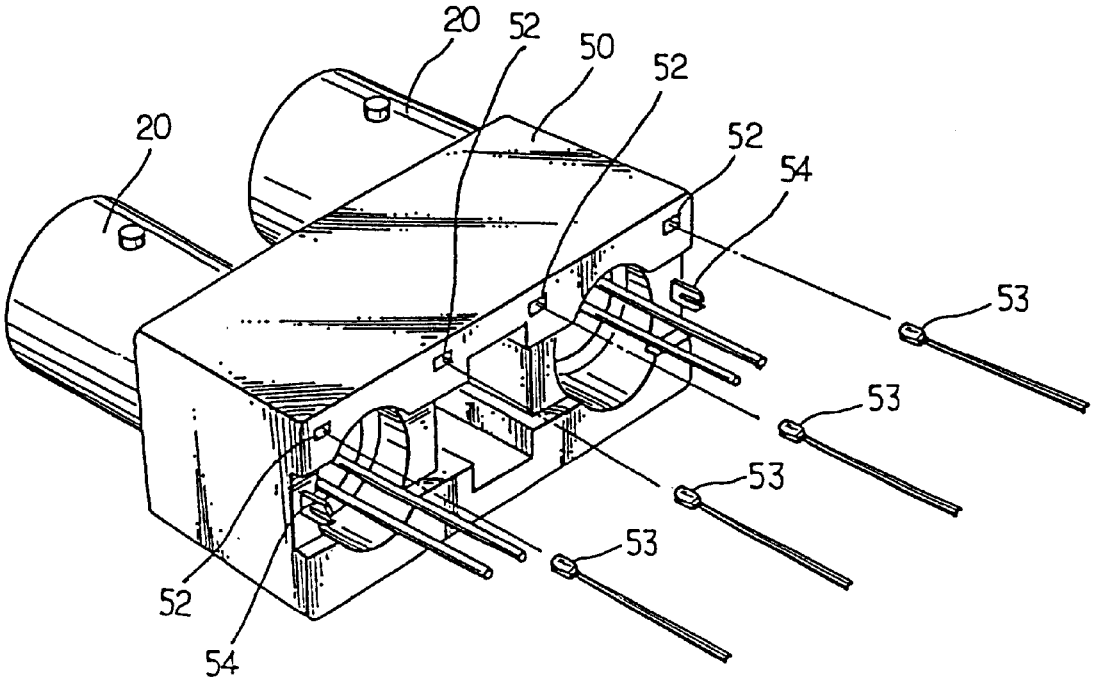

FIG. 21 shows two horizontal type dual-jack coaxial cable connectors according to the present invention. It shows that four indicator lights 53 can also be inserted into lamp holes 52 from the back of the base 50 instead of from the front of the base 50 shown on the FIG. 1.

The main spirit of the present invention is to provide a coaxial cable connector having indicator lights for indicating the connection of a network card or the transmission of a signal. The coaxial cable connector can be made in any of a variety of forms that function as conventional TNC or BNC connectors. The number of the coupling chamber of the base of the coaxial cable connector is determined subject to the number of the coaxial cable to be connected. The locations of the lamp holes and the number of the indicator lights can be adjusted as desired.

It is also the spirit of the present invention that the coupling chamber of the base and the lamp holes for the indicator lights can be made detachable for convenient production and installation. The connections between the first base member and the second base member of the second, third and fourth embodiments of the present invention are examples for understanding of the spirit of the invention only. It will be understood that various modifications and changes could be made without departing from the spirit and scope of the invention. For example, the shapes of the retaining holes and hooks of the second embodiment of the present invention of FIG. 4 may be variously embodied; the coupling grooves and coupling tongues of the third embodiment of the present invention of FIG. 5 may be interchanged between the first base member and the second base member; the coupling direction between the hooked portions of the second base member and the locating grooves of the first base member of the fourth embodiment of FIG. 4 may be changed.

What the invention claimed is:

1. A coaxial cable connector comprising: at least one jack, said at least one jack comprising a tubular shell, an insulative sleeve mounted inside said tubular shell, and a signal terminal mounted in said insulative sleeve and separated from said tubular shell; a first base member having at least one coupling chamber receiving said at least one jack such that the at least one jack extends from a surface of the first base member, and a plurality of locating grooves; a second base member having at least one lamp hole to receive at least one indicator light and a plurality of attaching portions engaging said plurality of locating grooves whereby said second base member is mounted to said first base members such that at least one indicator light faces in the same direction as the at least one jack extends from the first base member; and at least one locating pin extending from one of said first and second base members for fastening said coaxial cable connector to a PC board.

2. The coaxial cable connector of claim 1, wherein said second base member has a generally inverted U configuration having two leg portions extending on opposite sides of said first base member.

3. The coaxial cable connector of claim 2, wherein said attaching portions comprise hooked portions extend from each leg portion.

4. The coaxial cable connector of claim 2, wherein said at least one locating pin extends from at least one of said two leg portions.

5. The coaxial cable connector of claim 1, wherein said locating grooves comprise a plurality of retaining holes opening in the same direction and wherein said attaching portions comprise a plurality of hooks, one hook engaging each of said retaining holes.

6. The coaxial cable connector of claim 1, wherein said locating grooves open facing toward each other and wherein the attaching portions comprise a plurality of tongues extending from opposite sides of said second base member, one tongue engaging one of the locating grooves.

* * * * *